US011105080B2

(12) United States Patent
Ukigai et al.

(10) Patent No.: US 11,105,080 B2
(45) Date of Patent: Aug. 31, 2021

(54) TOILET SPACE DEODORIZING DEVICE AND SANITARY WASHING DEVICE

(71) Applicant: TOTO LTD., Kitakyushu (JP)

(72) Inventors: Kiyotake Ukigai, Kitakyushu (JP); Yuya Otowa, Kitakyushu (JP); Shoko Uemoto, Kitakyushu (JP); Shunichi Nakamichi, Kitakyushu (JP); Kanako Isono, Kitakyushu (JP)

(73) Assignee: TOTO LTD., Kitakyushu (JP)

( * ) Notice: Subject to any disclaimer, the term of this patent is extended or adjusted under 35 U.S.C. 154(b) by 0 days.

(21) Appl. No.: 16/545,288

(22) Filed: Aug. 20, 2019

(65) Prior Publication Data

US 2020/0123753 A1 Apr. 23, 2020

(30) Foreign Application Priority Data

Oct. 18, 2018 (JP) ..... JP2018-196775

(51) Int. Cl.
*E03D 9/00* (2006.01)

(52) U.S. Cl.
CPC ..... *E03D 9/00* (2013.01)

(58) Field of Classification Search
CPC ..... E03D 9/052; E03D 9/00
USPC ..... 4/209 R, 216
See application file for complete search history.

(56) References Cited

U.S. PATENT DOCUMENTS

2006/0064805 A1* 3/2006 Yamamoto ..... E03D 9/05 4/213

FOREIGN PATENT DOCUMENTS

JP 2017-223030 A 12/2017

* cited by examiner

*Primary Examiner* — Christine J Skubinna
(74) *Attorney, Agent, or Firm* — White & Case LLP

(57) ABSTRACT

A toilet space deodorizing device includes an intake part forming an intake port; an exhaust part forming an exhaust port; a fan device intaking air through the intake port; a water deodorizing part provided inside a deodorizing air channel, the deodorizing air channel linking the intake port and the exhaust port and allowing air to flow, the water deodorizing part using water to deodorize the suctioned air; a water supply part supplying water to the water deodorizing part; and a drainage part forming a drainage port, the drainage port draining water from the water deodorizing part into a drainage receptacle. The drainage port is positioned between the water deodorizing part and the water supply part. The water supply part supplies the water to the water deodorizing part via the drainage port.

4 Claims, 6 Drawing Sheets

TOILET SPACE DEODORIZING DEVICE AND SANITARY WASHING DEVICE

CROSS-REFERENCE TO RELATED APPLICATION

This application is based upon and claims the benefit of priority from Japanese Patent Application No. 2018-196775, filed on Oct. 18, 2018; the entire contents of which are incorporated herein by reference.

FIELD

The present invention relates to a toilet space deodorizing device and a sanitary washing device.

BACKGROUND

As a deodorizing device that deodorizes in a toilet space, a device is known in which offensive-odor components included in air are dissolved in water by causing the air to contact the water (e.g., Japanese Patent Application Publication No. 2017-223030). The deodorizing device according to Japanese Patent Application Publication No. 2017-223030 includes a water spraying device that is provided in a warm-water washing toilet seat and sprays water into air suctioned into a gas flow channel by a fan device. The water that adheres to suspended substances and offensive odors included in the gas falls onto a water storage part and subsequently is guided by a water guide part having a downward incline from the water storage part or falls onto the water guide part, and is drained via the water guide part into a toilet bowl part through an opening forming a drainage port.

SUMMARY

In a configuration including a water deodorizing part deodorizing by causing air including offensive odor components to contact water, for example, if the drainage port of the water deodorizing part is plugged by a biofilm forming due to residual water, the water that is sprayed from the water spraying device may collect inside the gas flow channel; and water leakage into the toilet space may occur from an opening other than the drainage port such as, for example, the exhaust port, a gap in the casing, etc. In particular, when driving the fan device, water may be undesirably suctioned into the fan device and caused to leak into the toilet space from the exhaust port.

A toilet space deodorizing device according to an aspect of the invention includes an intake part forming an intake port; an exhaust part forming an exhaust port; a fan device intaking air through the intake port; a water deodorizing part provided inside a deodorizing air channel, the deodorizing air channel linking the intake port and the exhaust port and allowing air to flow, the water deodorizing part using water to deodorize the suctioned air; a water supply part supplying water to the water deodorizing part; and a drainage part forming a drainage port, the drainage port draining water from the water deodorizing part into a drainage receptacle. The drainage port is positioned between the water deodorizing part and the water supply part. The water supply part supplies the water to the water deodorizing part via the drainage port.

DETAILED DESCRIPTION OF EMBODIMENTS

Figure 1:
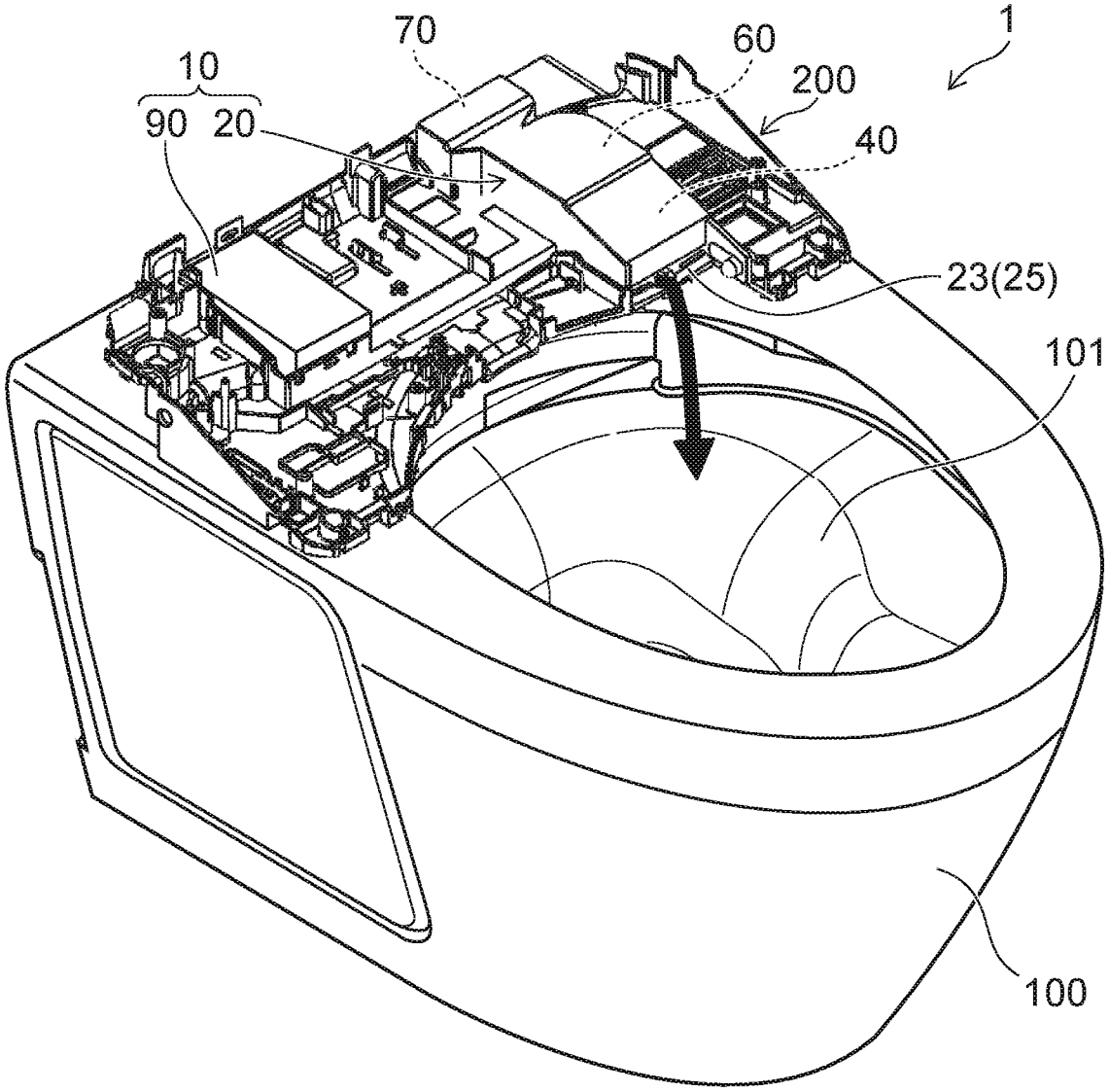
FIG. 1 is a perspective view of a toilet device according to one embodiment.

One of the embodiments of the invention will now be described with reference to the accompanying drawings. For easier understanding of the description, the same components in the drawings are marked with the same reference numerals when possible; and duplicate descriptions are omitted.

FIG. 1 is a perspective view of a toilet device 1 according to one embodiment.

As shown in FIG. 1, the toilet device 1 that is mounted in a toilet space includes a sit-down flush toilet (hereinbelow, called simply the toilet) 100, and a sanitary washing device 200 mounted on the toilet 100. The toilet 100 includes a bowl part 101 open upward in which water stores. By a user operating an operation part (not illustrated), the bowl part 101 is washed by washing water and drains the washing water through a drainage pipe (not illustrated). The sanitary washing device 200 includes a private part washing functional part that washes a private part such as the bottom or the like of the user sitting on the toilet 100 with a toilet seat (not illustrated) interposed, etc. The nozzle that is included in the private part washing functional part, etc., are not illustrated in FIG. 1.

The sanitary washing device 200 also includes a toilet space deodorizing device (hereinbelow, called simply the deodorizing device) 10. The deodorizing device 10 includes a water deodorizing unit 20 and a controller 30.

Figure 2:
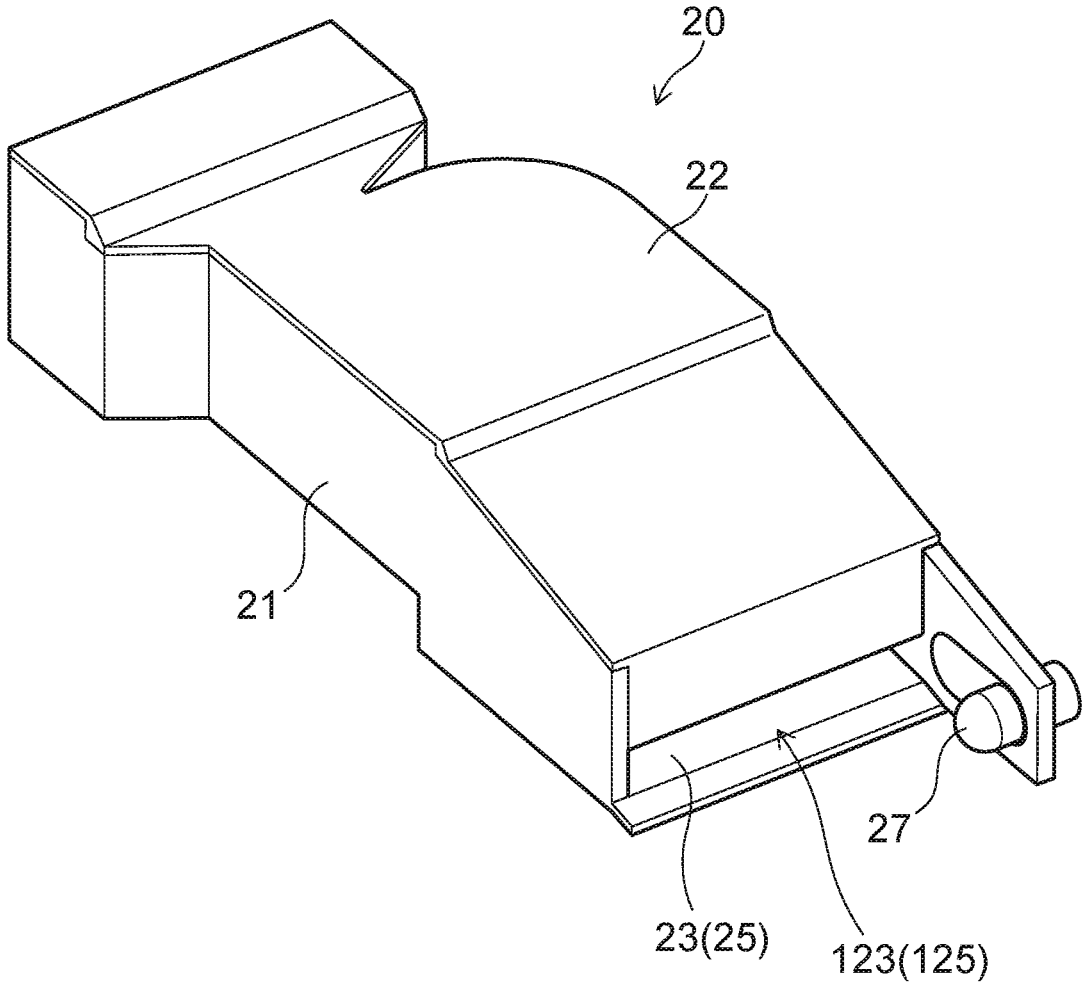
FIG. 2 is a perspective view of a water deodorizing unit according to one embodiment.

FIG. 2 is a perspective view of the water deodorizing unit 20 according to the embodiment.

Figure 3:
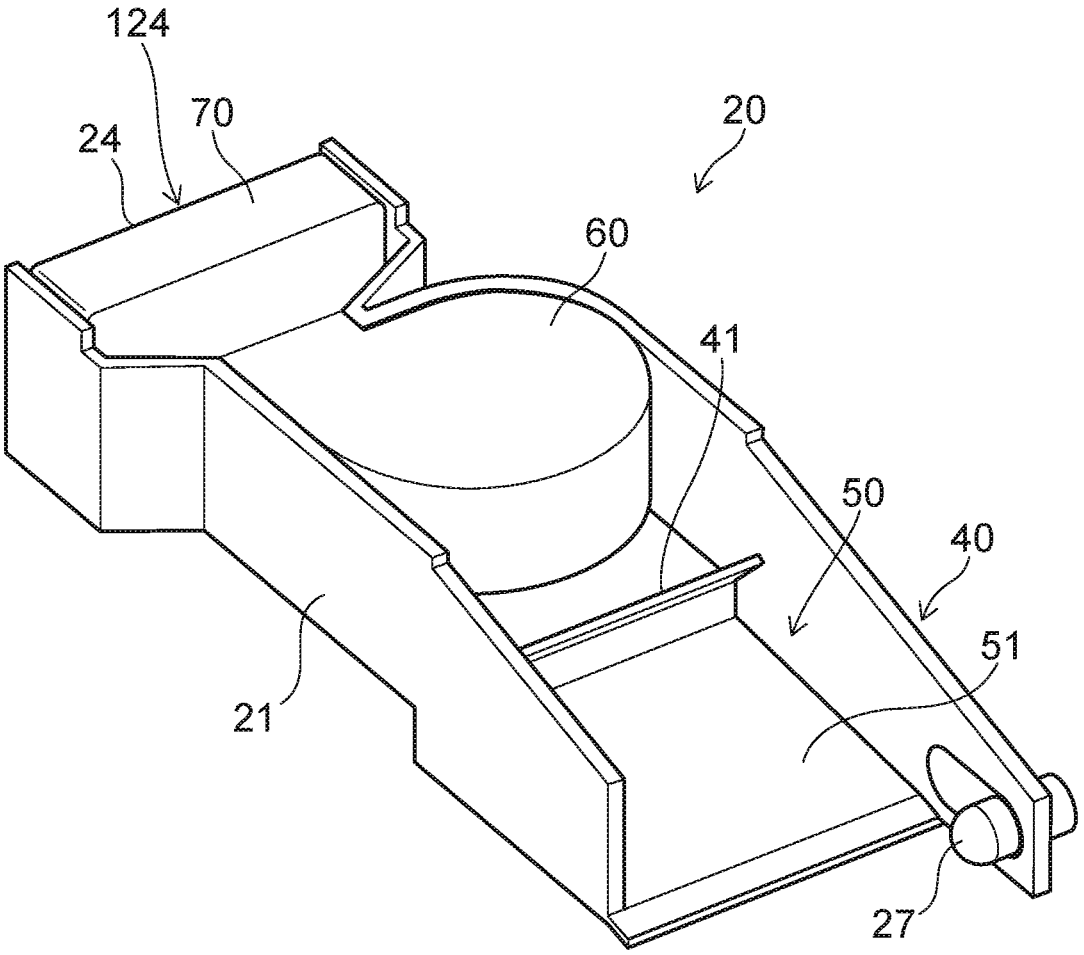
FIG. 3 is a perspective view of a state in which a cover is removed from the water deodorizing unit of FIG. 2.

FIG. 3 is a perspective view of a state in which a cover 22 is removed from the water deodorizing unit 20 of FIG. 2.

Figure 4:
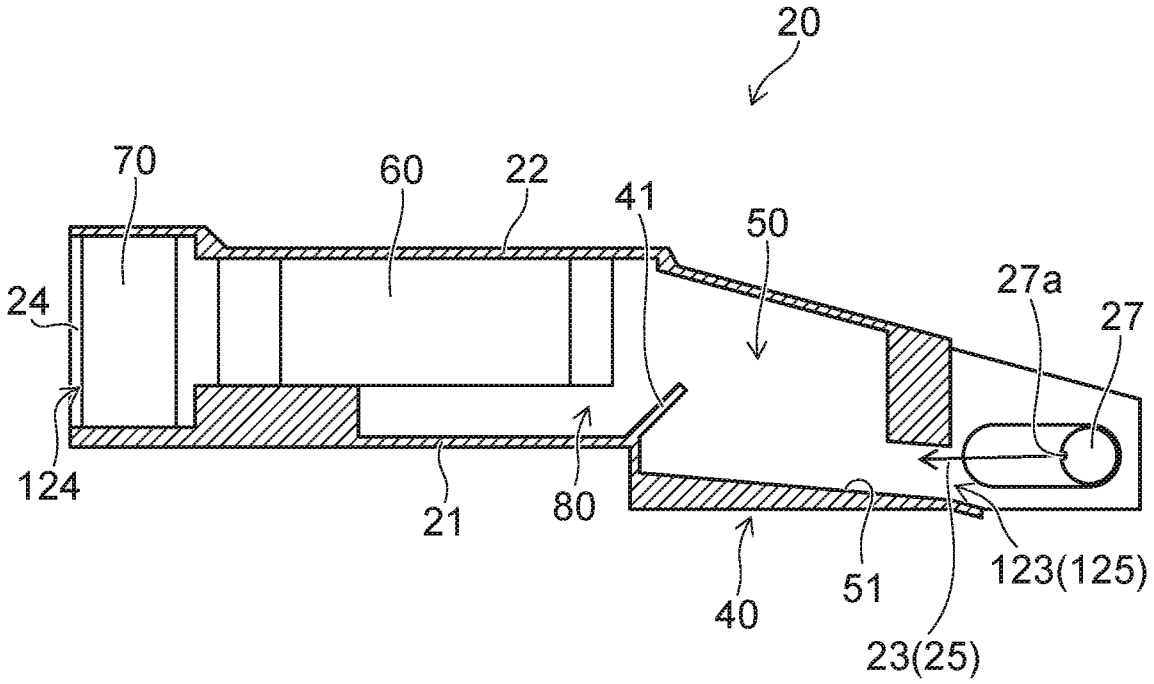
FIG. 4 is a cross-sectional view of the water deodorizing unit according to one embodiment.

FIG. 4 is a cross-sectional view of the water deodorizing unit 20.

As shown in FIG. 2 to FIG. 4, the water deodorizing unit 20 includes a case 21 and the cover 22. A water deodorizing part 40, a fan device 60, and an oxidation catalyst 70 are provided in the space between the case 21 and the cover 22.

Air is caused to flow through the space between the case 21 and the cover 22 by driving the fan device 60. An intake port part 123 is provided at one end part of an air channel (a deodorizing air channel) 80 through which the air flows; and an exhaust port part 124 is provided at the other end part of the deodorizing air channel 80. The intake port part 123 forms an intake port 23; and the exhaust port part forms an exhaust port 24. The deodorizing air channel 80 links the intake port 23 and the exhaust port 24. As described below, the intake port 23 also is used as the drainage port 25. The region of the deodorizing air channel 80 other than the intake port 23 and the exhaust port 24 is covered with the case 21 and the cover 22. The fan device 60 is a sirocco fan; for example, an axial fan or a cross-flow fan may be used.

The intake port 23 is positioned furthest upstream in the deodorizing air channel 80; and the exhaust port 24 is positioned furthest downstream in the deodorizing air channel 80. The fan device 60 is disposed downstream of the water deodorizing part 40 in the deodorizing air channel 80. The oxidation catalyst 70 is disposed downstream of the fan device 60 in the deodorizing air channel 80. The water deodorizing part 40, the fan device 60, and the oxidation catalyst 70 are arranged in order from the intake port 23 side between the intake port 23 and the exhaust port 24.

The water deodorizing part 40 includes a water collecting part 50. The water collecting part 50 is positioned between the intake port 23 and the fan device 60. The intake port 23 is open toward the bowl part 101 in the state in which the water deodorizing unit 20 is mounted on the toilet 100 shown in FIG. 1. Air is intaken through the intake port 23 into the water collecting part 50 by driving the fan device 60.

For example, a water supply part 27 is provided in an inner side surface of the case 21 at the vicinity of the drainage port 25. As shown in FIG. 4, the water supply part 27 is, for example, a water supply nozzle having a water supply port 27*a*. In the state in which the water deodorizing unit 20 is mounted on the toilet 100 shown in FIG. 1, the water supply part 27 is positioned outside the water collecting part 50 and is positioned above the opening of the bowl part 101. As shown in FIG. 4, the drainage port 25 is positioned between the water collecting part 50 and the water supply part 27. The water supply part 27 is positioned with the drainage port 25 interposed at the side opposite to the water collecting part 50, and provided at a position such that water can be supplied from the water supply part 27 to the water collecting part 50.

The water supply port 27*a* of the water supply part 27 is oriented toward the drainage port 25. For example, water is supplied from a water supply source (a service water line) to the water supply part 27; the water is supplied from the water supply port 27*a* via the drainage port 25 toward the water collecting part 50; and the water collecting part 50 is configured to collect the water.

The water that collected in the water collecting part 50 is drained through a drainage part 125 forming the drainage port 25. In the embodiment, the intake port 23 also is used as the drainage port 25. The drainage port 25 is open toward the bowl part 101 which is the drainage receptacle; and the water that is collected in the water collecting part 50 is drained through the drainage port 25 into the bowl part 101.

A water-receiving barrier 41 is provided in the water collecting part 50 at the fan device 60 side. The water-receiving barrier 41 protrudes from the bottom surface of the water collecting part 50 into the deodorizing air channel 80. A space is formed between the cover 22 and the upper end of the water-receiving barrier 41 and permits the flow of air from the water collecting part 50 toward the fan device 60. The water collecting part 50 has a bottom surface 51 having a downward incline along the direction from the water-receiving barrier 41 toward the drainage port 25.

An operation of the deodorizing device 10 according to the embodiment will now be described.

When seat contact of the user on the toilet 100 shown in FIG. 1 is detected, the fan device 60 is driven by a control of the controller 30; and water is supplied from the water supply part 27 to the water collecting part 50 by a control of the controller 30. Water is discharged from the water supply port 27*a* of the water supply part 27 toward the drainage port 25 as shown by the arrow shown in FIG. 4, and is supplied to the water collecting part 50 via the drainage port 25. The seat contact of the user on the toilet 100 is detected by a sensor provided in the toilet space (e.g. in the toilet seat and/or the toilet 100). It is sufficient for the sensor to be able to detect the presence or absence of the user. For example, the sensor may detect the user's departure, the user's approach. The sensor is an infrared sensor; for example, a microwave sensor or a pressure sensor may be used. The driving of the fan device 60 and the water supply from the water supply part 27 may be started by the operation of the operation unit (e.g. a remote controller or a touch panel) by the user.

For example, the driving of the fan device 60 and the water supply from the water supply part 27 are started simultaneously. Or, there may be a time lag between the water supply timing from the water supply part 27 and the timing of driving the fan device 60. The controller 30 controls the start and the stop of the driving of the fan device 60 and the start and the stop of the supply of the water from the water supply part 27. The fan device 60 that is driven by the controller 30 intakes air through the intake port 23 into the deodorizing air channel 80.

Figure 5:
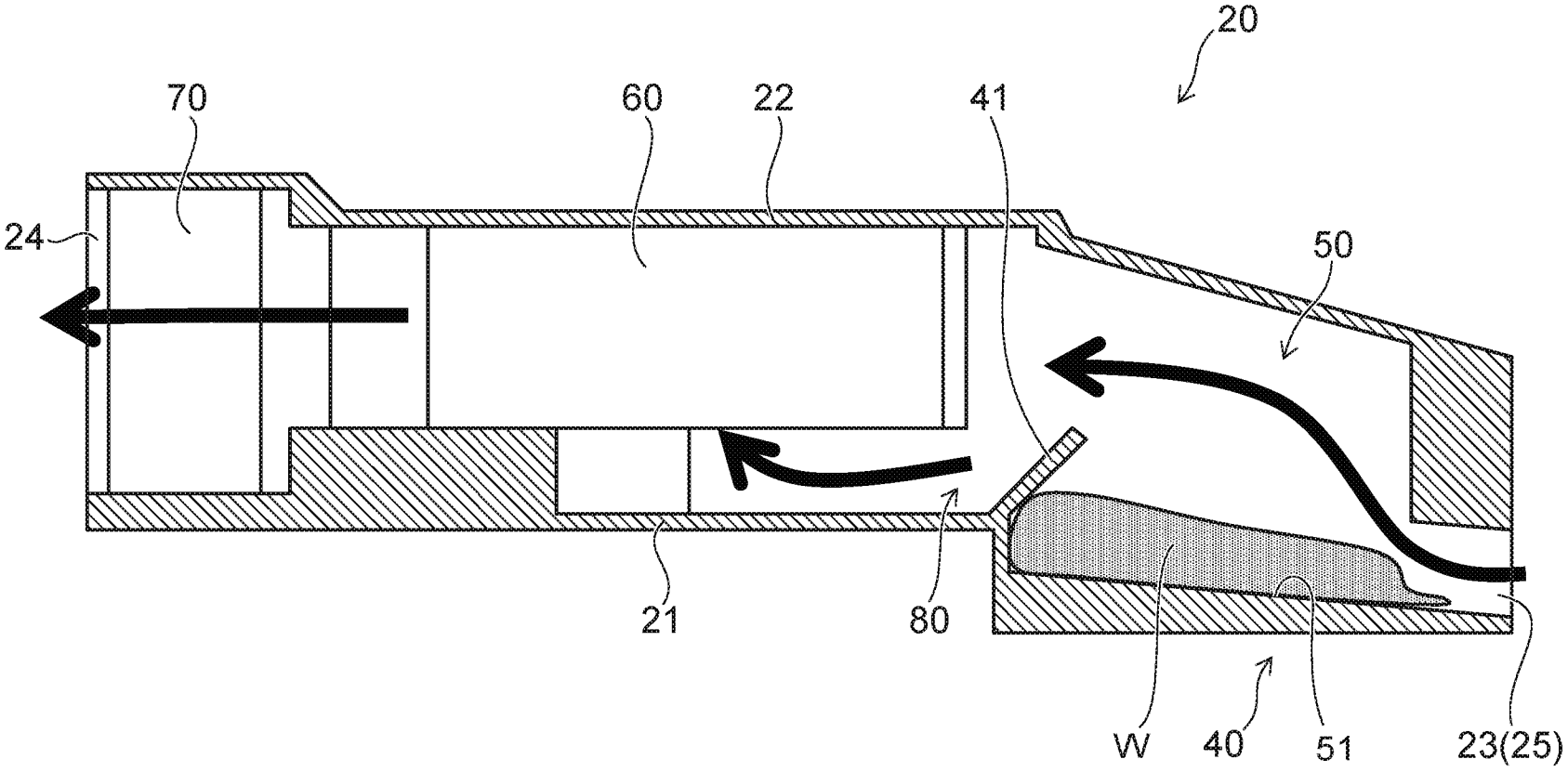
FIG. 5 is a schematic cross-sectional view of a water collection operation in the water deodorizing unit according to one embodiment.

FIG. 5 is a schematic cross-sectional view of the water collection operation in the embodiment.

In FIG. 5, the flow of the air inside the deodorizing air channel 80 is illustrated by black thick arrows. The air that is intaken through the intake port 23 flows through the space of the water collecting part 50 and is suctioned into the fan device 60; and the air that is discharged from the fan device 60 passes through the oxidation catalyst 70 and is exhausted from the exhaust port 24.

Air that is at atmospheric pressure is suctioned through the intake port 23 into the deodorizing air channel 80. In other words, the fan device 60 functions as a negative pressure generation device generating a negative pressure in the deodorizing air channel 80. The bottom surface 51 of the water collecting part 50 forms a downward incline toward the drainage port 25; therefore, the water that is supplied to the water collecting part 50 by the controller 30 can flow along the bottom surface of the water collecting part 50 toward the drainage port 25.

However, in the state in which the fan device 60 is driven, the water that is supplied from the water supply part 27 by the controller 30 can be collected in the water collecting part 50 because the negative pressure generated in the water collecting part 50 pushes, onto the water, air flowing in the reverse direction of the drainage direction of the water. Water W that is pushed by the air is dammed by the water-receiving barrier 41 and impeded from moving downstream in the deodorizing air channel 80. After a prescribed period of time, the supply of the water from the water supply part 27 is stopped by the controller 30.

The air that includes offensive-odor components and is intaken through the intake port 23 flows along the surface of water W collected in the water collecting part 50; and the surface of the water W collected in the water collecting part 50 forms a part of the deodorizing air channel 80. Then, the highly water-soluble offensive-odor components such as ammonia, trimethylamine, etc. are deodorized by being dissolved in the water W collected in the water collecting part 50.

The offensive-odor components such as hydrogen sulfide, methylmercaptan, etc. are not dissolved in the water W, and are in the air flowing further downstream through the deodorizing air channel 80 are deodorized by the oxidation catalyst 70. The oxidation catalyst 70 oxidizes and decomposes hydrogen sulfide and methylmercaptan.

Thus, according to the embodiment, ammonia and trimethylamine which are highly water-soluble can be deodorized by the water deodorizing part 40; and hydrogen sulfide and methylmercaptan which do not dissolve as easily in water as do ammonia and trimethylamine can be deodorized by the oxidation catalyst 70. The deodorized air is exhausted from the exhaust port 24.

Also, fine debris such as dust, paper bits, etc., suctioned through the intake port 23 with the air can be trapped by the water W collected in the water collecting part 50; and the performance decrease of the oxidation catalyst 70 due to the fine debris flowing into the oxidation catalyst 70 can be suppressed. The fine debris that undesirably reaches the fan device 60 also can be suppressed because the fan device 60 is disposed downstream of the water collecting part 50 in the deodorizing air channel. Normally, a mesh filter for trapping fine debris is provided at the intake port of the deodorizing device; however, in the embodiment, the fine debris can be trapped by the water collecting part 50; and a mesh filter may not be provided. Therefore, in the embodiment, the trouble of performing maintenance of the mesh filter can be eliminated.

By using a simple configuration in which one fan device 60 is used and the water deodorizing part 40 and the oxidation catalyst 70 are disposed inside one deodorizing air channel 80, both offensive-odor components having high water solubility and offensive-odor components having lower water solubility but higher oxidative decomposition capability can be deodorized effectively. Both the deodorizing performance and the avoidance of a larger size and a higher complexity can be realized.

Due to the formation of the negative pressure accompanying the flow of the air, the water W collects in the water collecting part 50; the surface of the water W forms a part of the deodorizing air channel 80; and the air that includes offensive odor components flows along the surface of the water W. Such a configuration causes a higher amount of air to contact the water surface compared to, for example, a configuration in which the water does not collect due to the formation of a negative pressure but the air is caused to contact the surface of water prestored in a tank; and the dissolution efficiency of the offensive-odor components in water can be increased. Accordingly, the embodiment realizes both the deodorizing performance and the avoidance of a larger size and a higher complexity.

Figure 6:
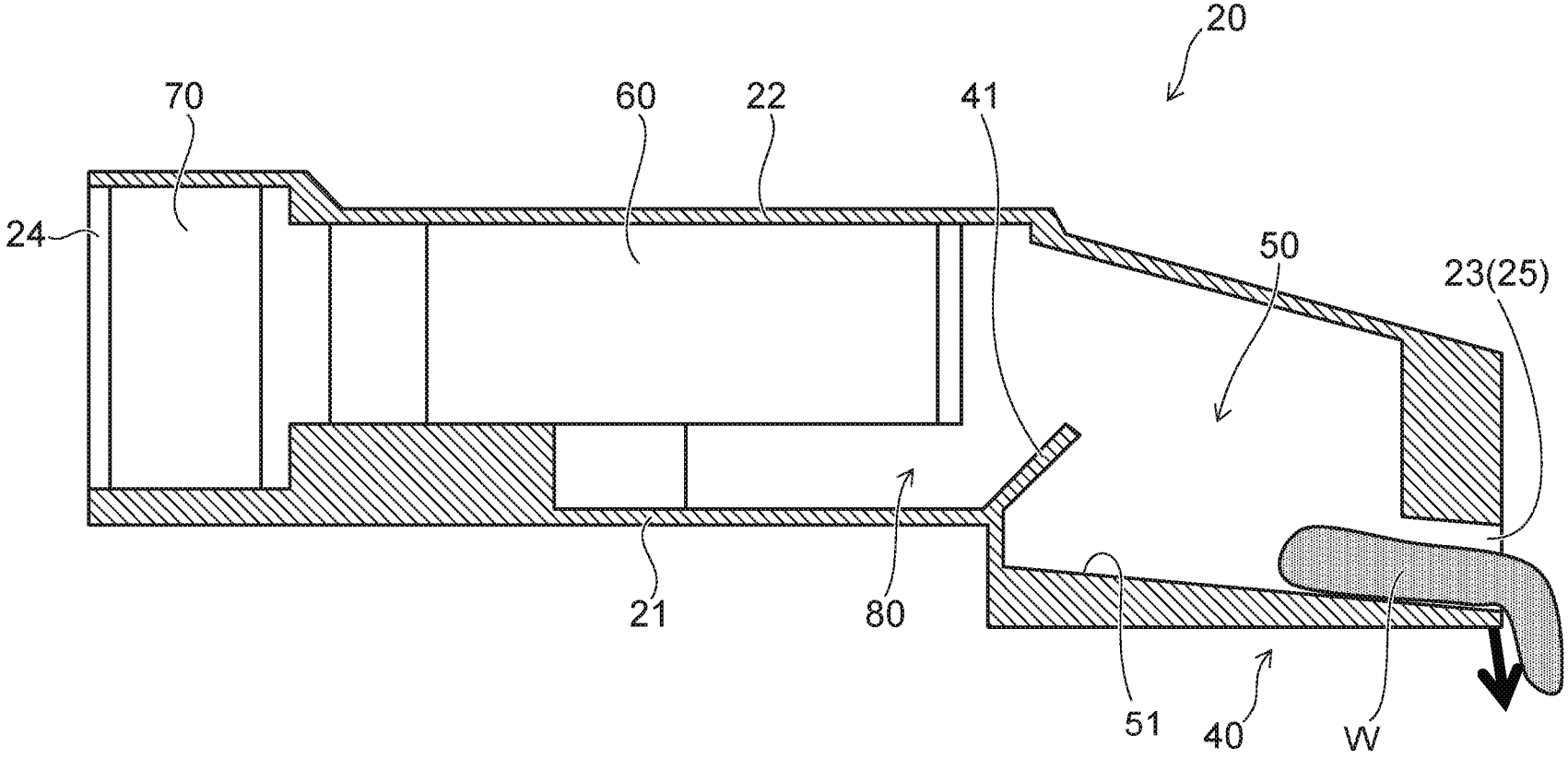
FIG. 6 is a schematic cross-sectional view of a drainage operation of the water deodorizing unit according to one embodiment.

FIG. 6 is a schematic cross-sectional view of the drainage operation in the embodiment.

The user rises from the toilet 100; and the controller 30 stops the driving of the fan device 60 based on the user rising from the toilet 100. When the fan device 60 is stopped, the water collecting part 50 returns to atmospheric pressure; and the force that holds the water W in the collected state is released. Then, because the bottom surface 51 of the water collecting part 50 has the downward incline toward the drainage port 25, the water W that collected in the water collecting part 50 is drained into the bowl part 101 of the toilet 100 (shown in FIG. 1) through the drainage port 25 as shown in FIG. 6. The fine debris that is trapped in the water W collected in the water collecting part 50, etc., also is drained with the water W. The sensor that is provided in the toilet space detects the user rising from the toilet 100. The driving of the fan device 60 may be stopped by the operation of the operation unit (e.g. a remote controller or a touch panel) by the user. The driving of the fan device 60 may be automatically stopped after a predetermined period of the starting of the driving of the fan device 60 by the operation of the operation unit.

If a movable member, e.g., a solenoid valve is used as the drainage mechanism, the water may not be drained due to a valve-opening failure caused by sticking of the solenoid valve; but in the embodiment, water drainage is possible merely by stopping the formation of the negative pressure by the fan device 60 without providing such a drainage mechanism. A simple configuration can drain the water from the water collecting part 50 and reduce the water remaining in the water collecting part 50; and the formation of the biofilm caused by the remaining water can be suppressed.

The configuration of the embodiment supplies the water to the water collecting part 50 via the drainage port 25 from outside the water collecting part 50; therefore, if the drainage port 25 is plugged by a biofilm, fine debris, etc., the water is obstructed by the plugging substance in the drainage port 25 and is not supplied to the water collecting part 50. Thereby, the undesirable leakage outside the device (outside the toilet device 1) from the exhaust port 24 due to water overflowing from the water collecting part 50 and being suctioned by the fan device 60 can be avoided.

The drainage port 25 is open toward the bowl part 101; and water is drained through the drainage port 25 into the bowl part 101. Therefore, the water drainage from the water deodorizing unit 20 can be processed by using a normal toilet in which the user operates an operation part to wash the bowl part 101 with washing water which is drained by a drainage pipe; and the functions of the embodiment described above can be realized by a simple configuration in which it is unnecessary to provide a drainage receptacle separately.

Because the water supply part 27 is positioned above the opening of the bowl part 101, if the drainage port 25 becomes plugged, the water that is discharged from the water supply part 27 splatters back due to the plugging substance in the drainage port 25 and can be drained reliably into the bowl part 101.

Although the configuration is not limited to a configuration in which the intake port 23 also is used as the drainage port 25, and the intake port 23 and the drainage port 25 may be provided as separate components, compared to the case of being provided separately, the functions of the embodiment described above can be realized by a simple configuration when the intake port 23 also is used as the drainage port 25.

For the same size (region), for example, the opening area of the drainage port can be wider when the intake port 23 also is used as the drainage port 25 than when the intake port 23 and the drainage port 25 are provided separately next to each other. The plugging occurs less easily as the opening area of the drainage port widens.

The water supply part 27 includes one or multiple water supply ports 27*a*. The water supply port 27*a* is not limited to a hole and may be a slit. The water supply part 27 may supply water to the water collecting part 50 via the drainage port 25 by spraying a water in a mist form.

Although an example is described in the embodiments described above in which the deodorizing device 10 is provided in the sanitary washing device 200, it is sufficient for the deodorizing device according to the invention to be provided in a toilet space including at least one of a flush toilet or a urinal; for example, the deodorizing device 10 may be provided in a urinal. In such a case, the drainage port may be open toward the bowl part surface of the urinal; and water may be drained through the drainage port toward the bowl part surface of the urinal which is the drainage receptacle.

Although an example is described in the embodiments described above in which a fan device is employed as the negative pressure generation device, the invention is not limited to forming the negative pressure by the air suction of the fan device 60; and it is sufficient for the negative pressure generation device to be able to form a negative pressure in the water collecting part. For example, a pump may be employed as the negative pressure generation device; and a negative pressure may be formed by the air suction of the pump.

Hereinabove, the embodiments of the invention are described with reference to specific examples. However, the invention is not limited to such specific examples; and various modifications based on the technical spirit of the invention are possible.

What is claimed is:

1. A toilet space deodorizing device, comprising:

an intake part forming an intake port;

an exhaust part forming an exhaust port;

a fan device intaking air through the intake port;

a water deodorizing part provided inside a deodorizing air channel, the deodorizing air channel linking the intake port and the exhaust port and allowing air to flow, the water deodorizing part using water to deodorize the suctioned air;

a water supply port supplying water to the water deodorizing part; and a drainage part forming a drainage port, the drainage port draining water from the water deodorizing part into a drainage receptacle, the drainage port being positioned between the water deodorizing part and the water supply port in a direction of a drainage flow path, the water supply port discharging the water toward the drainage port from outside the water deodorizing part and supplying the water to the water deodorizing part via the drainage port.

2. The toilet space deodorizing device according to claim 1, wherein the drainage port is the intake port.

3. A sanitary washing device provided in a toilet including a bowl part, the sanitary washing device comprising the toilet space deodorizing device according to claim 1, the drainage port being open toward the bowl part, water draining through the drainage port into the bowl part, the bowl part being the drainage receptacle.

4. The sanitary washing device according to claim 3, wherein the water supply part is positioned above an opening of the bowl part.

* * * * *